US006871430B1

(12) United States Patent
Landolt

(10) Patent No.: US 6,871,430 B1
(45) Date of Patent: Mar. 29, 2005

(54) PICTURE PERFECT CARD

(76) Inventor: Pamela J. Landolt, 13 Homer Pl., Poughkeepsie, NY (US) 12603

( * ) Notice: Subject to any disclaimer, the term of this patent is extended or adjusted under 35 U.S.C. 154(b) by 17 days.

(21) Appl. No.: 10/636,684

(22) Filed: Aug. 8, 2003

Related U.S. Application Data

(60) Provisional application No. 60/402,936, filed on Aug. 14, 2002.

(51) Int. Cl.[7] ..... G09F 1/00

(52) U.S. Cl. ..... 40/124.12; 40/124.09

(58) Field of Search ..... 40/124.09, 124.11, 40/124.12

(56) References Cited

U.S. PATENT DOCUMENTS

| | | | | | |
|---|---|---|---|---|---|
| 944,385 | A | * | 12/1909 | Spiegel | 40/124.09 |
| 2,203,578 | A | * | 6/1940 | Podmore | 40/124.09 |
| 2,547,359 | A | * | 4/1951 | Bacharach | 40/124.11 |
| 3,875,693 | A | | 4/1975 | Pelkey | |
| 4,450,638 | A | | 5/1984 | Bader | |
| 4,890,402 | A | | 1/1990 | Carroll | |
| 5,303,487 | A | | 4/1994 | Olson | |
| 5,361,521 | A | | 11/1994 | Burtch | |
| 5,575,094 | A | | 11/1996 | Leake et al. | |
| 5,822,896 | A | * | 10/1998 | Milstein | 40/124.12 |
| 5,822,897 | A | * | 10/1998 | Ertzan | 40/124.09 |
| 6,209,924 | B1 | * | 4/2001 | Pyle et al. | 40/124.12 |
| 6,449,891 | B1 | * | 9/2002 | Miska | 40/124.12 |

* cited by examiner

*Primary Examiner*—Gary C. Hoge
(74) *Attorney, Agent, or Firm*—Patent & Trademark Services, Inc.; Joseph H. McGlynn

(57) ABSTRACT

A greeting card which holds a picture, and made up of three parts. A user folds one part behind the center part and inserts a photograph between the two parts. Adhesive may be applied to secure the photograph or may be applied on two of the three edges between the one part and the center part before the photograph is inserted. A third part can be folded behind or in front of the center part.

7 Claims, 2 Drawing Sheets

PICTURE PERFECT CARD

Applicant claims priority of Provisional application Ser. No. 60/402,936, filed Aug. 14, 2002.

BACKGROUND OF THE INVENTION

This invention relates, in general, to greeting cards, and, in particular, to a greeting card which holds a picture.

DESCRIPTION OF THE PRIOR ART

In the prior art various types of card devices have been proposed. For example, U.S. Pat. No. 3,875,693 to Pelkey discloses a photo easel made in three parts, with the center holding the photo and the sides forming a support stand.

U.S. Pat. No. 5,361,521 to Burtch discloses a display frame having three parts, the center for a photo and one of the end parts has a foot that serves as a support.

U.S. Pat. No. 5,303,487 to Olson discloses a display card made in three parts, the center part holds a photo and the sides have pressure sensitive adhesive to seal the photo.

U.S. Pat. No. 4,450,638 to Bader discloses a photo display card with a plurality of hinged panels that can be folded to make its own mailer.

U.S. Pat. No. 5,575,094 to Leake et al discloses a combination greeting card and picture frame.

U.S. Pat. No. 4,890,402 to Carroll discloses a photograph holding greeting card.

The present invention combines greeting cards and matted photographs. The present invention allows the exchange of greeting cards, which has long been used as an expression of personal messages for all types of occasions and communication of feelings. To enhance the personal significance of the greeting card and to function as a memento when fully utilized, the present invention will hold visual, personal memories for the giver and receiver of the card.

The construction of the present invention allows a photograph, or other pictorial representation, to be sent via a greeting card. The receiver of the card will have a visual representation that can be immediately displayed and will create treasured memories.

Also, words of greeting can be displayed in various portions of the card, along with instructions as to how to fold the card in order to use it, or the instructions could be provided separate from the card.

SUMMARY OF THE INVENTION

The present invention is directed to a greeting card which holds a picture, and which is made up of three parts. A user folds one part behind the center part and inserts a photograph between the two parts and may use adhesive to secure the photograph, and a third part can be folded behind or in front of the two parts.

It is an object of the present invention to provide a new and improved greeting card.

It is an object of the present invention to provide a new and improved greeting card which also holds a photograph.

It is an object of the present invention to provide a new and improved greeting card which can easily and quickly accommodate a photograph.

These and other objects and advantages of the present invention will be fully apparent from the following description, when taken in connection with the annexed drawings.

DESCRIPTION OF THE PREFERRED EMBODIMENT

Figure 1:
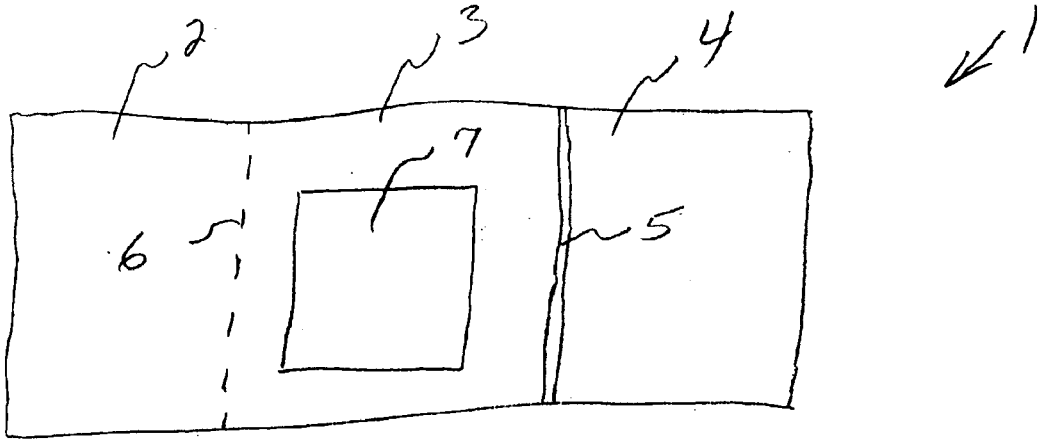
FIG. 1 is plan view of the present invention showing all three parts.

Referring now to the drawings in greater detail, FIG. 1 shows the present invention 1, which comprises a greeting card made as a single sheet divided into approximately three equal parts 2, 3, 4. The card 1 is preferably made from greeting card stock, however, other materials can be used without departing from the scope of the invention. Also, the entire card is preferable 5×7 inches, although other sizes can be used without departing from the scope of the invention.

The first or center section 3 of the card has a cutout or aperture 7 which will receive a photograph (not shown). When the photograph is placed behind the cutout 7, at least a portion of the photograph will show though the cutout as though the photograph was matted. Also, the size and shape of the cutout 7 can be varied to hold different sized photographs and viewing designs.

Figure 2:
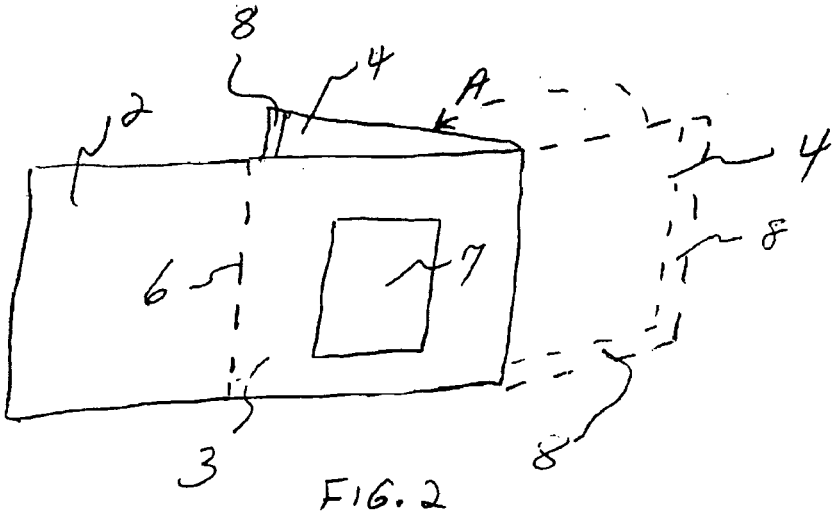
FIG. 2 is a perspective view of the present invention showing one of the panels being folded.

Between the center section 3 and the part of the card 4 (the second section), on the right hand side in FIG. 1, is a fold line 5. The fold line 5 extends approximately from the top of the card to the bottom, and will allow part 4 to be folded behind the center part 3, as shown in FIG. 2 by the arrow A and the dotted lines showing the original position of part 4 and the solid lines showing part 4 being folded into its new position. Once part 4 is completely folded into position behind center part 3, adhesive 8 can be applied between parts 3 and 4 on two edges leaving one edge open and a picture can be placed between the center part and part 4. If adhesive is used on the parts before the card and picture are assembled, one portion of the parts 3 and 4 should not have adhesive applied so the photograph can be slipped between parts 3, 4. It should be noted that while the adhesive 8 is shown as being applied to section 4 in FIG. 2, it should be understood that the adhesive could be applied to section 3, or part of it could be applied to section 3 and part to section 4.

Figure 3:
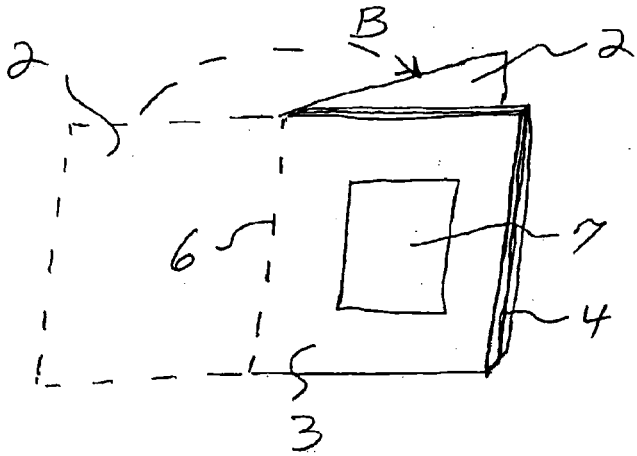
FIG. 3 is a perspective view of the present invention showing another of the panels being folded.

As shown in FIG. 3, a perforation line 6 extends between center section 3 and the part of the card 2 (the third section) on the left hand side in FIG. 3. The perforation line 6 extends approximately from the top of the card to the bottom, and will serve two purposes. It will allow part 2 to be folded behind the center part 3, as shown in FIG. 3 by the arrow B and the dotted lines showing the original position of part 2 and the solid lines showing part 2 being folded into its new position. In this position, the photograph can be displayed for viewing.

Figure 4:
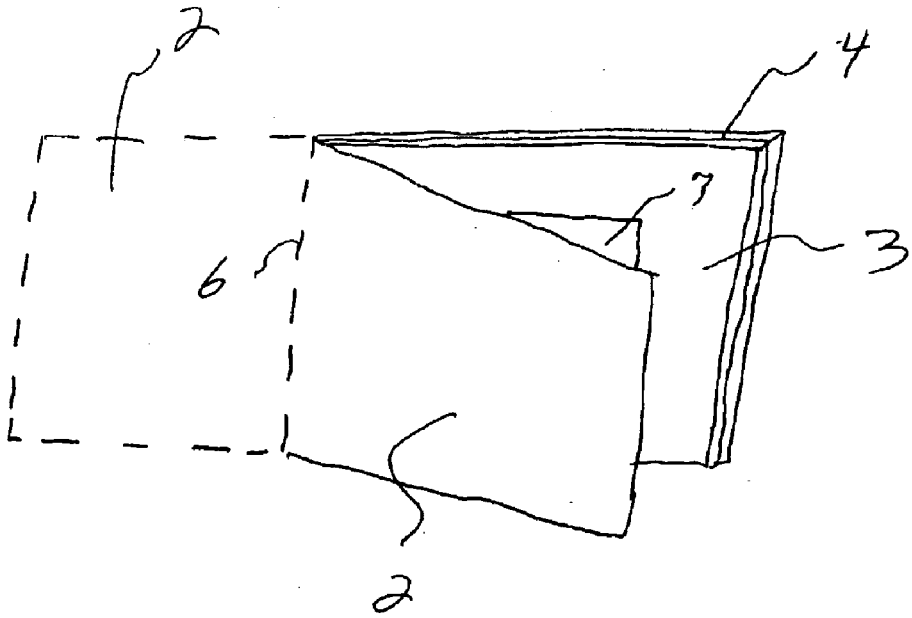
FIG. 4 is a perspective view of the present invention showing another of the panels being folded in a different position.

As shown in FIG. 4, part 2 can be folded in front of center section 3 which will protect the photograph, for example if the card is sent through the mail.

Figure 5:
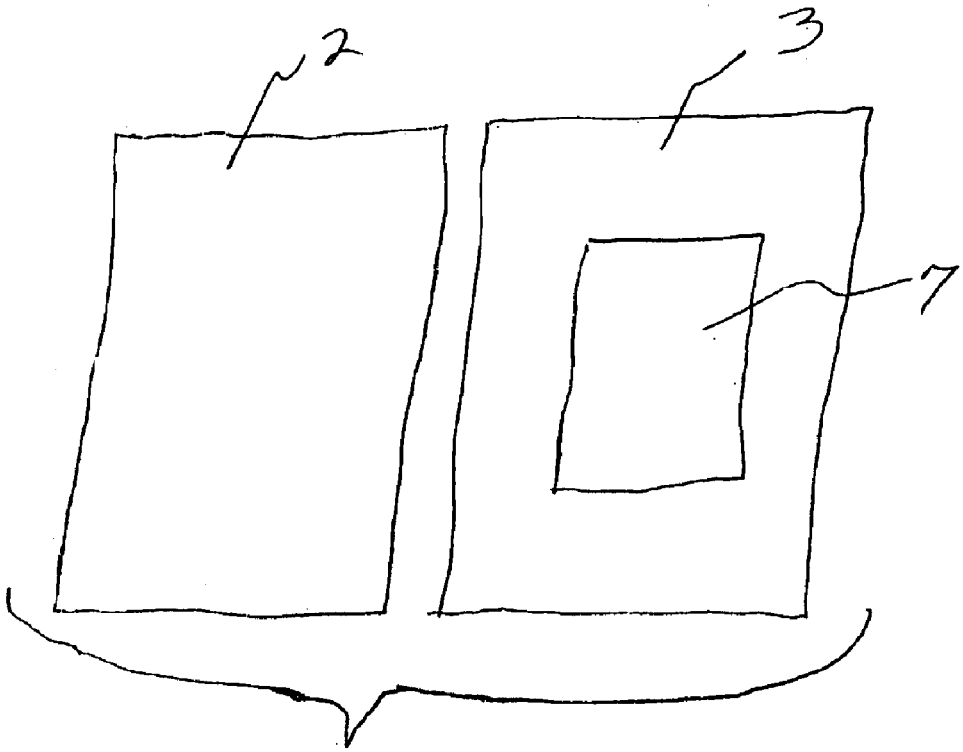
FIG. 5 is plan view of the present invention showing one of the parts removed.
Figure 1:
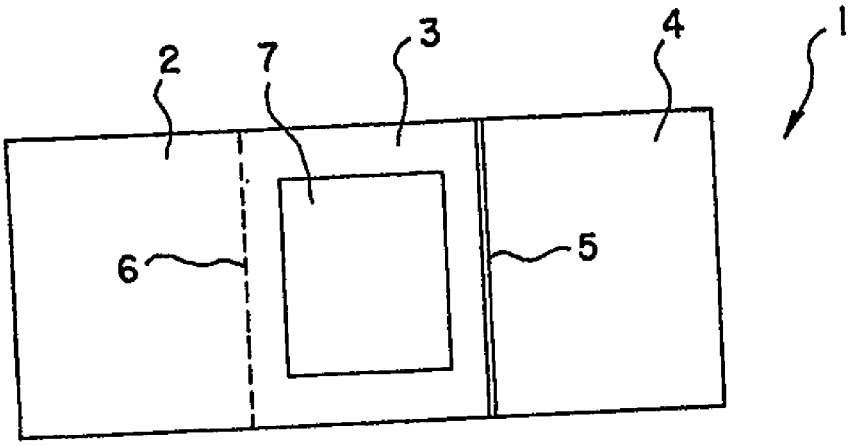
Figure 2:
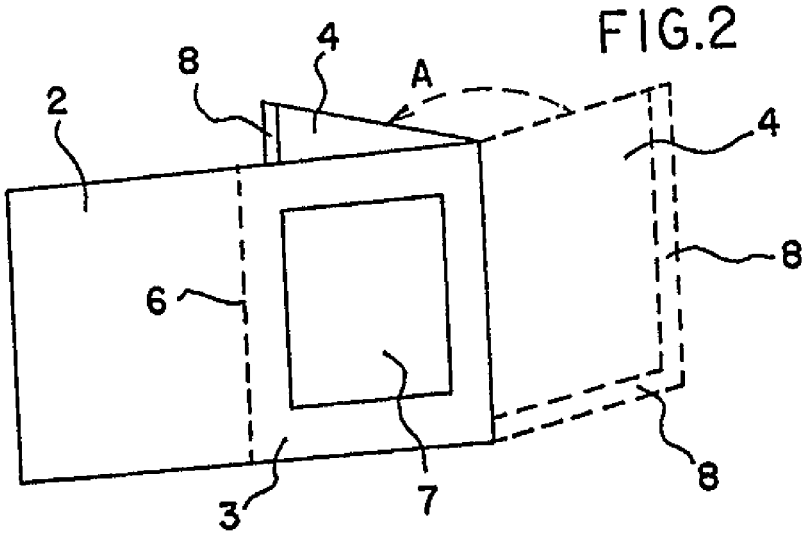
Figure 3:
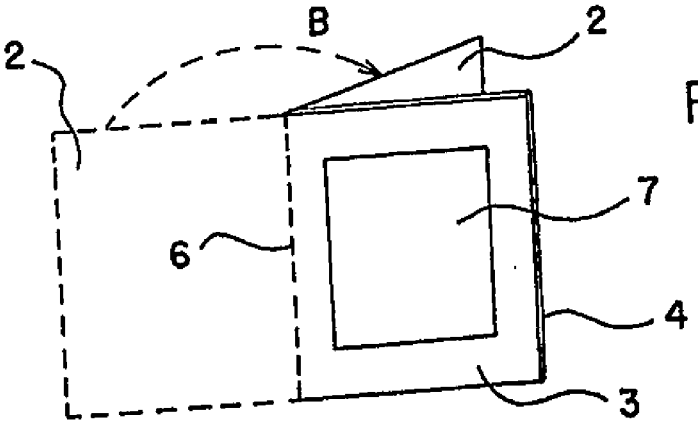
Figure 4:
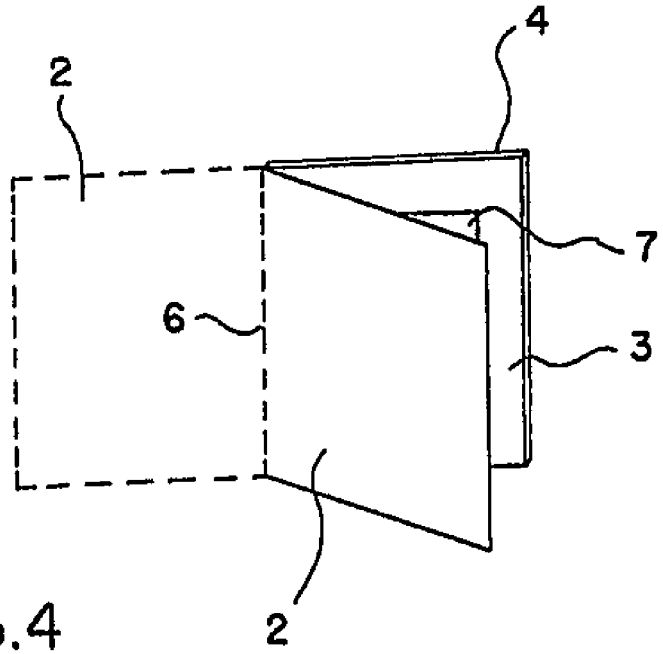
Figure 5:
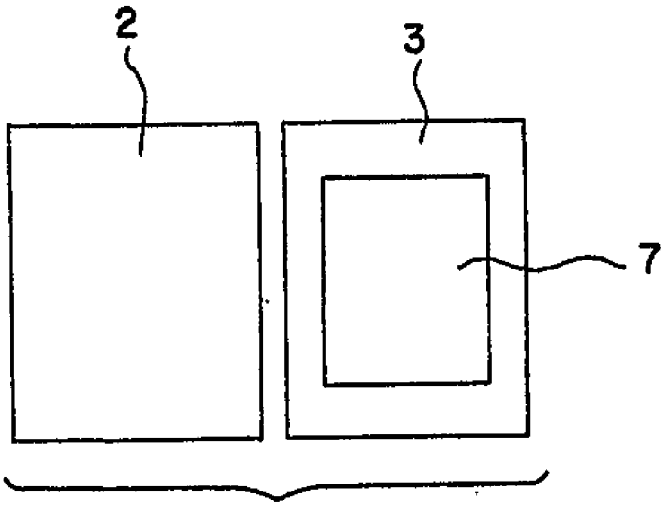

As shown in FIG. 5, once the card is received, part 2 can be separated at the perforation line 6 to yield a matted photograph which may be placed in a picture frame for display.

Although the Picture Perfect Card and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A greeting card adapted to hold a photograph, said greeting card comprising:

first, second and third sections, each of said first, second and third sections having a length and a width, a top and bottom and sides connecting said top and bottom, said first and second sections having adjacent sides and said first and third sections having adjacent sides, each of said first, second and third sections being secured together along said adjacent sides, said first section having an aperture extending therethrough, said second section and said first section having means extending between said first and second sections for allowing said second section to be folded behind said first section, and said first and third sections having means extending between said first and third sections for allowing said third section to be folded behind said first section, and said first and third sections having means extending between said first and third sections for allowing said third section to be separated from said first section, and wherein one of said first and second sections has adhesive means for securing said first section to said second section when said second section is folded behind said first section, and wherein said adhesive means is on only two edges of one of said first section and said second section, and said adhesive means is positioned along said bottom and one of said sides of said first and second sections, and wherein said one of said sides is a side opposite from said means extending between said first and second sections for allowing said second section to be folded behind said first section.

2. The greeting card as claimed in claim 1, wherein said means extending between said first and second sections for allowing said second section to be folded behind said first section is a fold line extending along the length of said first and second sections.

3. The greeting card as claimed in claim 1, wherein said means extending between said first and third sections for allowing said third section to be folded behind said first section is a perforation line.

4. The greeting card as claimed in claim 1, wherein said means extending between said first and third sections for allowing said third section to be separated from said first section is a perforation line.

5. The greeting card as claimed in claim 1, wherein said means extending between said first and third sections for allowing said third section to be folded behind said first section and said means extending between said first and third sections for allowing said third section to be separated from said first section is the same means.

6. The greeting card as claimed in claim 1, wherein said adhesive means is on said first section.

7. The greeting card as claimed in claim 1, wherein said adhesive means is on said second section.

* * * * *

UNITED STATES PATENT AND TRADEMARK OFFICE

CERTIFICATE OF CORRECTION

PATENT NO. : 6,871,430 B1
APPLICATION NO. : 10/636684
DATED : March 29, 2005
INVENTOR(S) : Pamela J. Landolt It is certified that error appears in the above-identified patent and that said Letters Patent is hereby corrected as shown below:

The title page should be deleted to appear as per attached title page.

The sheets of drawings, consisting of figures 1-5 should be deleted to appear as per attached figures 1-5.

Signed and Sealed this

Twenty-eighth Day of August, 2007

JON W. DUDAS
*Director of the United States Patent and Trademark Office*

(12) United States Patent
Landolt

(10) Patent No.: US 6,871,430 B1
(45) Date of Patent: Mar. 29, 2005

(54) PICTURE PERFECT CARD

(76) Inventor: Pamela J. Landolt, 13 Homer Pl., Poughkeepsie, NY (US) 12603

( * ) Notice: Subject to any disclaimer, the term of this patent is extended or adjusted under 35 U.S.C. 154(b) by 17 days.

(21) Appl. No.: 10/636,684

(22) Filed: Aug. 8, 2003

Related U.S. Application Data

(60) Provisional application No. 60/402,936, filed on Aug. 14, 2002.

(51) Int. Cl.[7] ..... G09F 1/00
(52) U.S. Cl. ..... 40/124.12; 40/124.09
(58) Field of Search ..... 40/124.09, 124.11, 40/124.12

(56) References Cited

U.S. PATENT DOCUMENTS

| | | | | | |
|---|---|---|---|---|---|
| 944,385 | A | * | 12/1909 | Spiegel | 40/124.09 |
| 2,203,578 | A | * | 6/1940 | Podmore | 40/124.09 |
| 2,547,359 | A | * | 4/1951 | Bacharach | 40/124.11 |
| 3,875,693 | A | | 4/1975 | Pelkey | |
| 4,450,638 | A | | 5/1984 | Bader | |
| 4,890,402 | A | | 1/1990 | Carroll | |
| 5,303,487 | A | | 4/1994 | Olson | |
| 5,361,521 | A | | 11/1994 | Burtch | |
| 5,575,094 | A | | 11/1996 | Lenke et al. | |
| 5,822,896 | A | * | 10/1998 | Milstein | 40/124.12 |
| 5,822,897 | A | * | 10/1998 | Ertzan | 40/124.09 |
| 6,209,924 | B1 | * | 4/2001 | Pyle et al. | 40/124.12 |
| 6,449,891 | B1 | * | 9/2002 | Miska | 40/124.12 |

* cited by examiner

*Primary Examiner*—Gary C. Hoge
(74) *Attorney, Agent, or Firm*—Patent & Trademark Services, Inc.; Joseph H. McGlynn

(57) ABSTRACT

A greeting card which holds a picture, and made up of three parts. A user folds one part behind the center part and inserts a photograph between the two parts. Adhesive may be applied to secure the photograph or may be applied on two of the three edges between the one part and the center part before the photograph is inserted. A third part can be folded behind or in front of the center part.

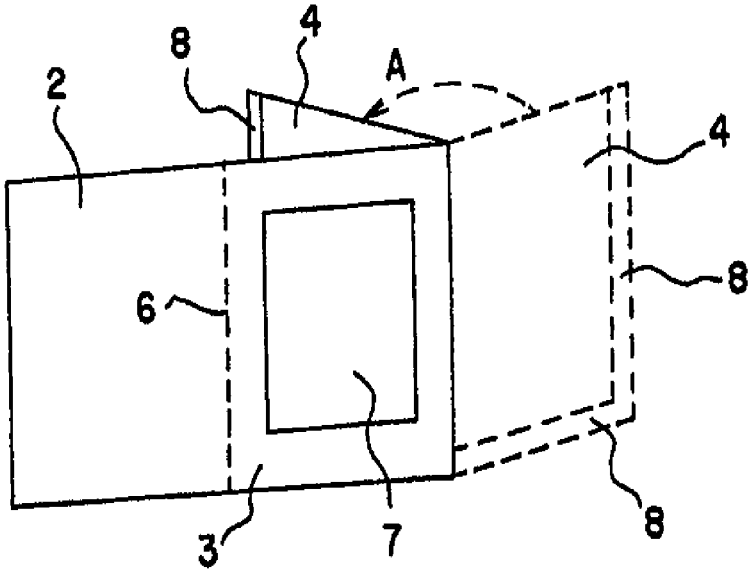

7 Claims, 2 Drawing Sheets